United States Patent [19]

Lampietti

[11] 3,934,445

[45] Jan. 27, 1976

[54] DUAL PURPOSE SPRING COILING MACHINE

[75] Inventor: Bernard Lampietti, Goshen, Conn.

[73] Assignee: Torin Corporation, Torrington, Conn.

[22] Filed: June 24, 1974

[21] Appl. No.: 482,089

[52] U.S. Cl. ..... 72/129; 72/138; 72/140

[51] Int. Cl.[2] ..... B21F 11/00

[58] Field of Search ..... 72/138, 129, 131, 140

[56] References Cited

UNITED STATES PATENTS

| | | | |
|---|---|---|---|
| 2,248,440 | 7/1941 | Schmid | 72/129 |
| 2,393,804 | 6/1944 | Nigro | 72/138 |
| 2,455,863 | 12/1948 | Halvorsen | 72/138 |

FOREIGN PATENTS OR APPLICATIONS

| | | | |
|---|---|---|---|
| 740,185 | 10/1943 | Germany | 72/138 |

*Primary Examiner*—C. W. Lanham
*Assistant Examiner*—Robert M. Rogers
*Attorney, Agent, or Firm*—McCormick, Paulding & Huber

[57] ABSTRACT

A dual purpose spring coiling machine adapted for two point and single point coiling and particularly adapted for convenient and rapid convertibility from one form of coiling to the other. The machine comprises a coiling tool slide assembly mounted on a frame generally opposite a wire feed and guide means and adjacent a coiling station. The tool slide assembly comprises a coiling tool slide and a guide mountable selectively on the frame in three discrete positions. Right and left-hand two point coiling positions respectively employ mounting of the guide in first and second positions inclined upwardly and downwardly 22½° from the horizontal. Single point coiling is achieved with the guide mounted horizontally. Coiling tool holders mounted on the slide may be selectively moved from one position to another for right and left-hand coiling with a first holder mounted on and movable with the slide. A second holder is mounted indirectly on the slide with a lever pivotally connected with the slide at an intermediate portion, fixed at one end portion and carrying the tool holder an an opposite and free end portion. The said holder is movable with and relative to the slide along an arc during rectilinear sliding movement. With the slide and tool holder arrangement diameter adjustments and control is achieved simultaneously through slide adjustment and control. A manual control takes the form of a screw and lock nut engageable with the slide and entered through threaded openings in the frame selectively with the guide in each of its three positions. An automatic control comprises an actuating lever and link selectively connectible with the slide in each of the three guide positions. The control also includes cam and motion transmitting means for operation of the control in timed relationship with the feed means and for diameter adjustment during coiling. A third tool holder for single point coiling is mounted on the slide with the guide in the horizontal position and the holder includes adjustment means for positioning a coiling tool above and below the line of wire feed respectively for right and left-hand springs. The manual and automatic diameter adjustment and control means are also operable with the slide and guide in horizontal position for single point coiling. A pair of laterally spaced locating pins projecting rearwardly from the guide are entered selectively in three pairs of locating holes in the frame for convenience in changing from one position to another and/or from one form of coiling to another.

29 Claims, 7 Drawing Figures

DUAL PURPOSE SPRING COILING MACHINE

BACKGROUND OF THE INVENTION

The present invention relates to an improved spring coiling machine of the general type which is adapted for the intermittent feeding of predetermined lengths of wire, the said lengths of wire being coiled during feeding to form springs and the wire being cut off on completion of feeding and coiling. While not necessarily so limited, the invention is particularly applicable to spring coiling machines of the type shown in U.S. Pat. No. 2,119,002 issued May 31, 1938 to Bergevin and Nigro.

U.S. Pat. No. 2,455,863 issued Dec. 7, 1948 to E. W. Halvorsen.

U.S. Pat. No. 2,820,505 issued Jan. 21, 1958 to E. E. Franks et. al.,

U.S. Pat. No. RE24,345 issued Aug. 20, 1957 to C. R. Bergevin,

U.S. Pat. No. 2,902,079 issued Sept. 1, 1959 to Costello et al.,

U.S. Pat. No. 2,923,343 issued Feb. 2, 1960 to Franks,

U.S. Pat. No. 2,925,115 issued Feb. 16, 1960 to Franks,

U.S. Pat. No. 3.009,505 issued Nov. 21, 1961 to Franks,

U.S. Pat. No. 3,068,927 issued Dec. 18, 1862 to Bergevin, and

U.S. Pat. No. 3,402,584 issued Sept. 24, 1968 to Cavagnero.

More particularly, the invention relates to improved tooling in spring coiling machines of the general type mentioned and improvements in mounting elements etc. in the machine which relate to the tooling. Such improvements adapt the machine for both two point and single point coiling and, moreover, change over from one form of coiling to the other is achieved with a high degree of ease and convenience. As is well known, single point coiling is favored in the United States and two point coiling throughout much of the remaining areas of the world.

SUMMARY OF THE INVENTION

It is the general object of the present invention to provide a dual purpose spring coiling machine adapted for both two point and single point coiling, and adapted further for the ready change over from one coiling form or mode to another and from right to left-hand coiling in each coiling form or mode.

A further object of the invention involves the provision of an improved mounting means for first and second coiling tool holders carried by a single tool slide but mounted thereon in such manner as to provide for the simultaneous adjustment of coiling tools or points in different directions merely by adjustment of the slide.

A still further object of the invention is to provide for a mounting means on a tool slide whereby one tool holder may be adjusted approximately along a line which departs angularly a substantial extent from the line of movement of the slide.

A still further object of the invention resides in the provision of such a mounting means wherein the adjustment of said one tool holder occurs along a shallow arc approximating a straight line adjustment.

DESCRIPTION OF PREFERRED EMBODIMENT

In the specification hereinbelow and in the claims which follow, various terms directional and/or geometrical in nature such as "longitudinal", "horizontal", "front", "rear", "upwardly", "downwardly", etc. are employed. It is to be understood that such terminology is used in a relative sense only and is not to be taken in anyway as a limitation upon the present invention.

Figure 1:
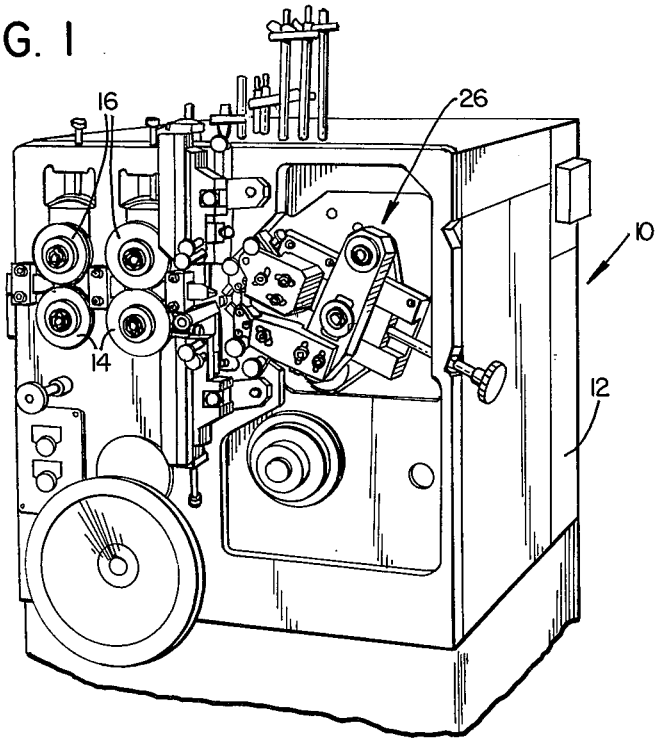
FIG. 1 is a perspective view in a somewhat schematic form and illustrating a dual purpose spring coiling machine constructed in accordance with the present invention.

Referring particularly to FIG. 1, it will be observed that a spring coiling machine indicated generally at 10 comprises an upstanding main supporting frame or housing 12. At a front and left-hand portion of the frame or housing 12, a feed means is provided for intermittently advancing spring wire in a horizontal longitudinal direction. The said feed means takes the form of conventional feed rolls 14, 16 and it will be apparent that the line of wire feed extends horizontally from left to right and through a wire guide means 18, best illustrated in FIG. 2, to a coiling station A. At the coiling station A, a small arbor 20 is supported on the frame 12 and projects laterally and generally horizontally forwardly so as to be engaged by wire advanced longitudinally past the guide means 18 by the feed rolls 14, 16. That is, the arbor 20, as is well known, forms a part of the coiling system in a single point coiling operation and is engaged by the wire during coiling of a spring. In a two point coiling operation, the arbor 20 is not necessarily engaged by the wire during coiling of the spring but may serve only as an anvil during a cut-off operation. Thus, the term arbor is used in a general sense and not in the limiting sense as employed in the trade in a single point coiling operation where the arbor forms a necessary part of the coiling system or geometry during coiling of the springs. As will be apparent, various sizes of arbors may be provided and adjustment of arbor position for coiling and/or cut-off use may be achieved in a conventional manner.

Figure 4:
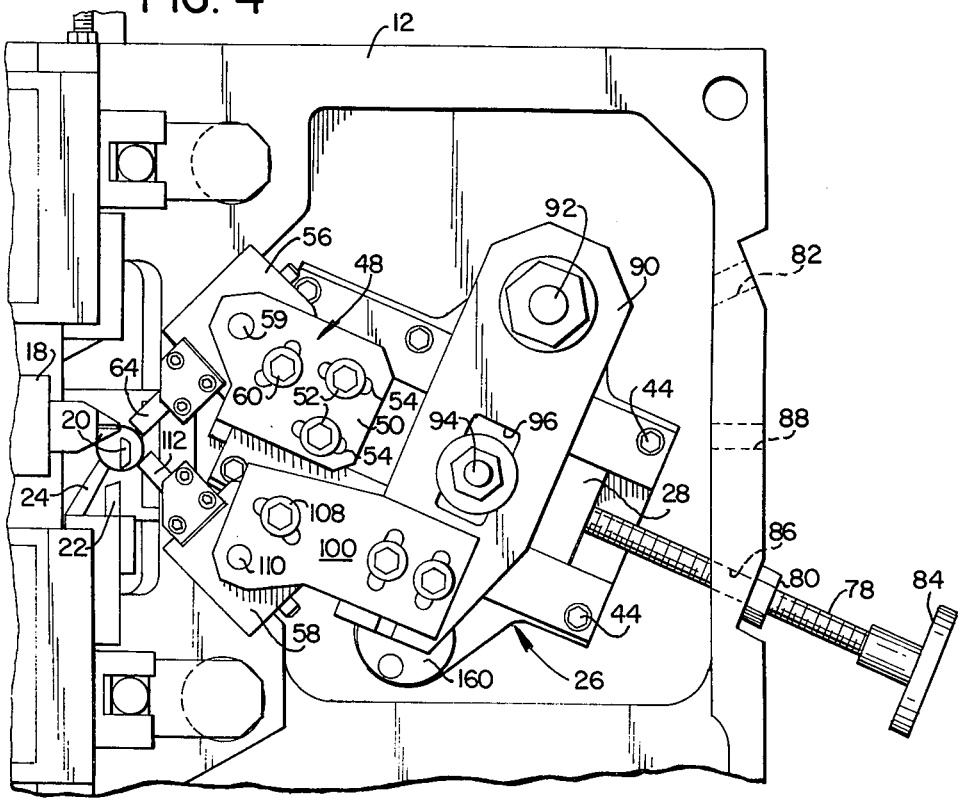
FIG. 4 is an enlarged fragmentary view similar to FIG. 2 but showing a tool slide assembly positioned for two point left-hand spring coiling.

A cut-off tool 22 at the coiling station A may be conventional in construction and operation and as will be apparent, the said tool can cooperate with the arbor or anvil 20 in movement toward the spring for severing a spring after formation therof. A rectilinear movement of the cut-off tool 22 is provided for in a direction toward and away from a spring, but it is of course also possible to employ a pivotal cut-off tool. Referring particularly to FIG. 4, it will be observed that the cut-off tool 22 is moved to a lower position for the formation of left-hand springs. Means for accomplishing the selective upper or lower mounting of the tool may be conventional. In FIG. 4 it will also be observed that the arbor or anvil 20 is adjusted to a lower position for left-hand coiling.

Figure 2:
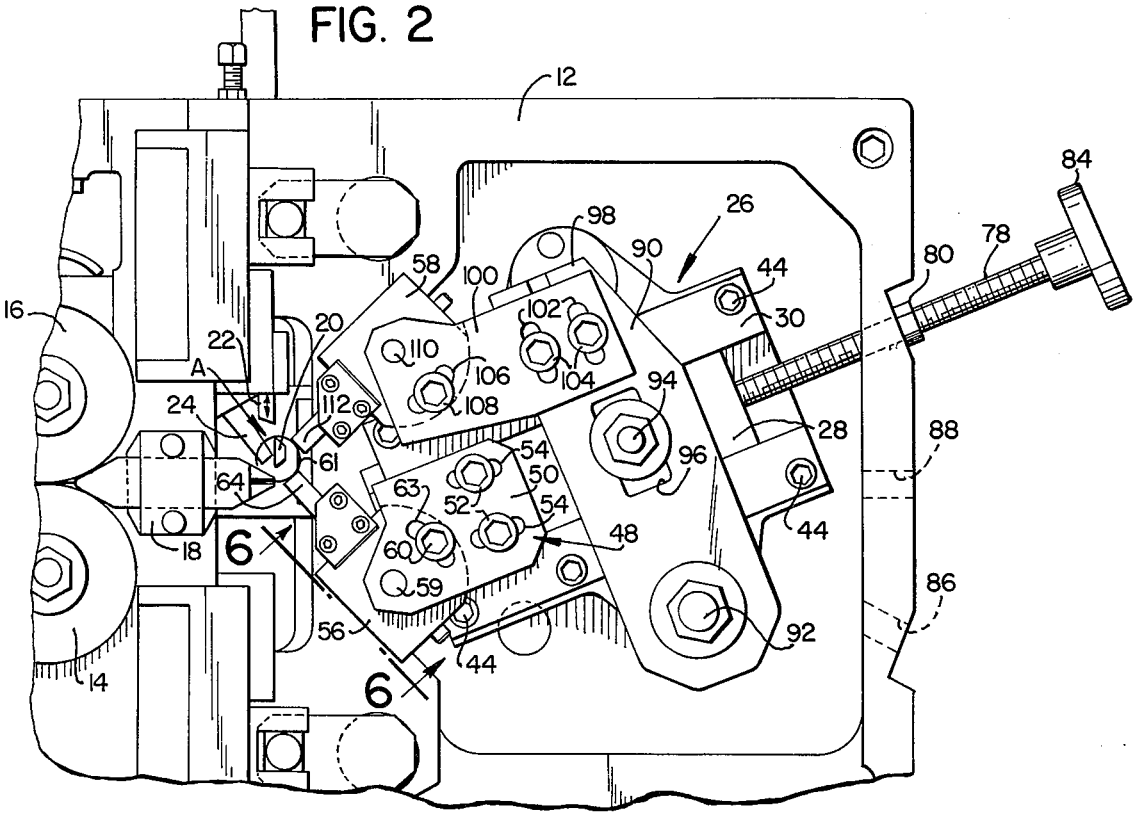
FIG. 2 is an enlarged fragmentary front view of the machine of FIG. 1 showing a coiling station, feed and guide means and a tool slide assembly constructed in accordance with the present invention, the tool slide assembly being positioned for two point right-hand coiling.
Figure 5:
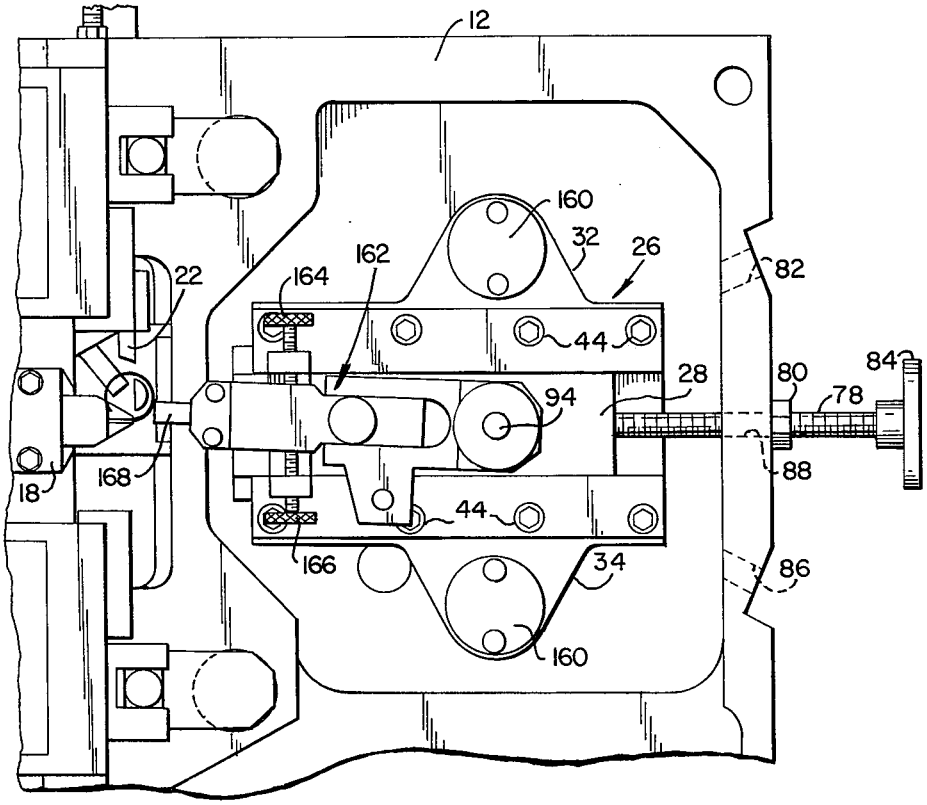
FIG. 5 is a view similar to FIGS. 2 and 4 but showing the tool slide assembly mounted on the machine frame for single point coiling of right-hand springs.

There is also provided at the coiling station A, a pitch tool which may be conventional and which is supported by the machine frame and engages wire as it is advanced and coiled to spring form. The pitch tool is operable laterally to displace the wire whereby to "pitch" the spring. A pitch tool 24 is illustrated in FIG. 2 in position for right-hand two point coiling and in FIG. 4 the tool 24 is shown in position for left-hand two point coiling. In FIG. 5, the pitch tool 24 is shown in position for right-hand single point coiling.

A coiling machine 10 as thus far described may be substantially conventional in form and reference may be had to one or more of the aforementioned patents for further detailed illustration and description.

In accordance with the present invention, a coiling tool slide assembly indicated generally at 26 is provided on a side of the coiling station A and arbor 20 generally opposite the feed means 14, 16 and the wire guide means 18. The coiling tool slide assembly is mountable selectively on the frame 12 in at least two discrete positions and as illustrated and further described hereinbelow and said assembly is mountable selectively on the frame in three discrete positions. The first position of the slide assembly 26 illustrated in FIG. 2 is employed when two point right-hand spring coiling is desired, the second position of FIG. 4 when two point left-hand spring coiling is desired, and the horizontal position of FIG. 5 when single point right or left-hand spring coiling is desired. In accordance with conventional practice, the slide assembly in FIG. 2 is inclined upwardly at an angle of 22½° from the horizontal when viewed from the coiling station. Similarly, the assembly in FIG. 4 is inclined downwardly from the horizontal at an angle of 22½°.

Figure 3:
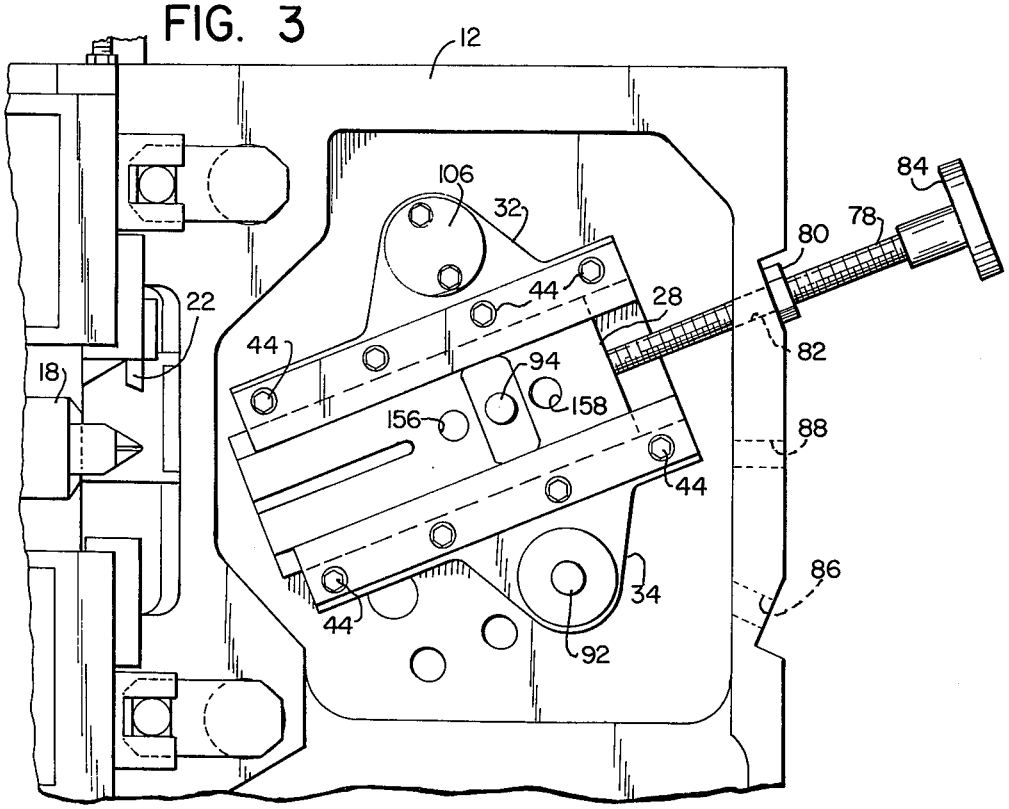
FIG. 3 is a fragmentary enlarged view similar to FIG. 2 but showing coiling tool holders and mounted means therefor removed from a front portion of the tool slide.

The coiling tool slide assembly 26 comprises a coiling tool slide 28 and a guide therefor indicated at 30. The guide 30 supports the slide 28 for rectilinear movement in one and an opposite direction generally toward and away from the coiling station A in each of the three positions of the slide assembly. The guide 30 may vary in construction but is preferably provided with upwardly and downwardly extending lugs 32, 34 best illustrated in FIG. 3. The lugs 32, 34 each contain a rearwardly projecting locating pin. Said pins are not visible behind the lugs but it will be apparent that they comprise a pair of laterally spaced locating pins cooperable with three pairs of locating holes in the frame 12, FIG. 7. Thus, the locating pins at the rear of the guide 30 may be entered in locating holes 32, 34 with the tool slide assembly in the FIG. 2 position for two point right-hand coiling. For the mode of machine operation wherein two point left-hand coiling is desired as in FIG. 4, the locating holes 36, 38 are employed, and for single point right-hand or left-hand coiling locating holes 40, 42 are employed. Various means of attaching the guide 30 in each of its three positions may of course be provided. The presently preferred practice employs a plurality of bolts as at 44, 44 and appropriately spaced holes 46, 46 in the frame 12. As will be apparent, the locating pins on the lugs 32, 34 may be entered in the proper locating holes in the frames and the bolts then simply and conveniently threaded into the aligned bolt holes therebehind.

Further in accord with the present invention, at least two coiling tool holders are provided for selective mounting on the tool slide 28 and for movement therewith. A first tool holder indicated generally at 48 in FIGS. 2 and 4 is mounted on and movable with the slide 28 in a rectilinear manner and in one and an opposite direction toward and away from the coiling station A. As illustrated, the tool holder 48 comprises a mounting bracket 50 adjustably secured on the slide 28 by suitable bolts 52, 52 extending through elongated adjustment slots 54, 54. The bracket 50 may be so designed as to be reversible from the FIG. 2 to the FIG. 4 position or, as a matter of convenience, separate mounting brackets may be provided respectively for right and left-hand coiling. A principal or body member of the tool holder 48 illustrated at 56 may be substantially identical with a member 58 forming a part of a second tool holder. Thus, description of the said body 56 and associated adjustment means will suffice for description of the holder 58 as well.

Figure 6:
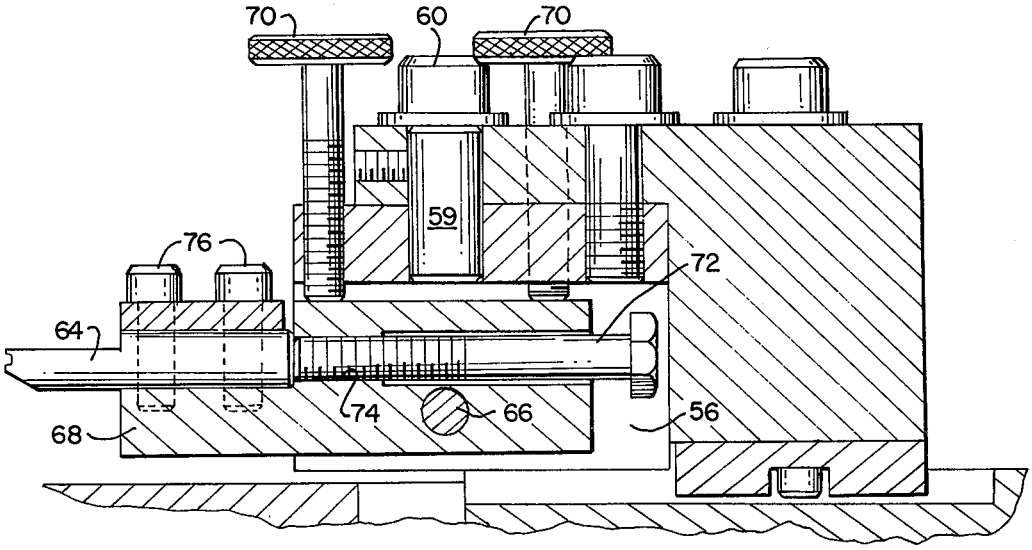
FIG. 6 is an enlarged sectional view taken generally as indicated at 6—6 in FIG. 2 and illustrating the detailed construction of a tool holder.

With particular reference to FIGS. 2 and 6, it will be observed that the body 56 of the tool holder is adjustable about a pivot pin 59 in a plane perpendicular to the axis of a spring such as 61 being coiled at the coiling station A. An arcuate slot 63 provides for such adjustment and a binder screw 60 locks the body 56 in a desired position of adjustment. As will be apparent, a coiling tool or point 64 carried by the tool holder is swung arcuately at its free end by such adjustment of the body 56. A pivot pin 66 in FIG. 6 provides for the arcuate adjustment of a point or tool carrying element 68 in a plane in common with the axis of a spring such as 61. Thus, the element 68 may be adjusted and locked in a desired poition of adjustment by binder screws 70, 70. Axial adjustment or adjustment of the coiling tool or point 64 toward and away from a spring such as 61 is provided for by an adjusting screw 72 threaded in a suitable opening 74 in the element 68 and the tool or point 64 may also be rotatably or angularly adjusted. Thus, small binder screws 76, 76 may be released to provide for such axial, rotatable or angular adjustment of the tool or point 64 and thereafter tightened to secure the tool or point in a desired position for coiling.

As will be apparent, a coiling tool or point 64 may be precisely located in a set-up operation and desired adjustments having been effected, the slide 28 may be adjusted for spring diameter control. Thus, the coiling tool or point 64 will move approximately tangentially with respect to a spring such as 61 along a line inclined upwardly at an angle of 22½° from the horizontal. The slide 28 may be moved rightwardly and upwardly in FIG. 2 for larger diameter springs and, conversely, downwardly and leftwardly for smaller diameter springs.

A manual diameter control or adjustment means takes the form of an adjustment screw 78 connectible at a forward end portion with the slide 28 and having an associated lock nut 80. A threaded opening 82 in the frame 12 receives the screw 78 and a manually operable knob 84 may be provided for convenience of diameter adjustment. With the slide assembly 26 in the FIG. 4 position for left-hand two point coiling, the diameter adjustment screw 78 may be selectively entered in a threaded opening 86 aligned with the slide 28, and when a slide assembly is in a single point horizontal position of FIG. 5 a threaded opening 88 in the frame 12 may be similarly employed.

The aforementioned second tool holder is preferably mounted on the slide 28 indirectly and by means of intermediate supporting means or device in the form of a lever 90. The lever 90 is fixed with respect to the guide 30 at a lower end portion by a pin 92. That is, the lever 90 pivots above the pin 92 but is fixed relative to the slide 28 so as to be driven in one and an opposite direction by a pin 94 at an intermediate portion thereof. The pin 94 projects forwardly from the slide 28, FIG. 3, and through a suitable opening 96 in the lever 90. At an upper or free end portion 98 of the lever 90 in FIG. 2, a bracket 100 forming a part of the second tool holder is adjustably secured by means of slots 102 and appropriate bolts 104, 104. The bracket 100 has a slot 106 and a mounting bolt 108 for the aforementioned holder body portion 58. A pivot pin 110 similar to the aforementioned pin 59 provides for angular adjustment of the body 58 in a plane perpendicular to the axis of a spring 61. The body 58 of the holder, as mentioned above, may be otherwise identical with the body 56.

A coiling tool or point 112 held by the second tool holder is so arranged as to move along a shallow arc in one and an opposite direction when the side 28 is moved in one and an opposite direction whereby to drive the lever 90 through action of the pin 94. The arc of movement of the tool or point 112 approximates a straight line over the extent of movement required and lies approximately along a line inclined 22½° from the vertical and intersecting the radii of springs of varying diameter. Thus, when the slide 28 is adjusted along its guide 30 for diameter adjustment, the coiling tools or points 64, 112 are simultaneously adjusted for diameter control or adjustment. The tool or point 64 moves with the slide and the tool or point 112 moves both with and relative to the slide 28, as is required in two point coiling adjustment, and a simplified and yet highly efficient diameter control and adjustment operation is thus achieved.

Figure 7:
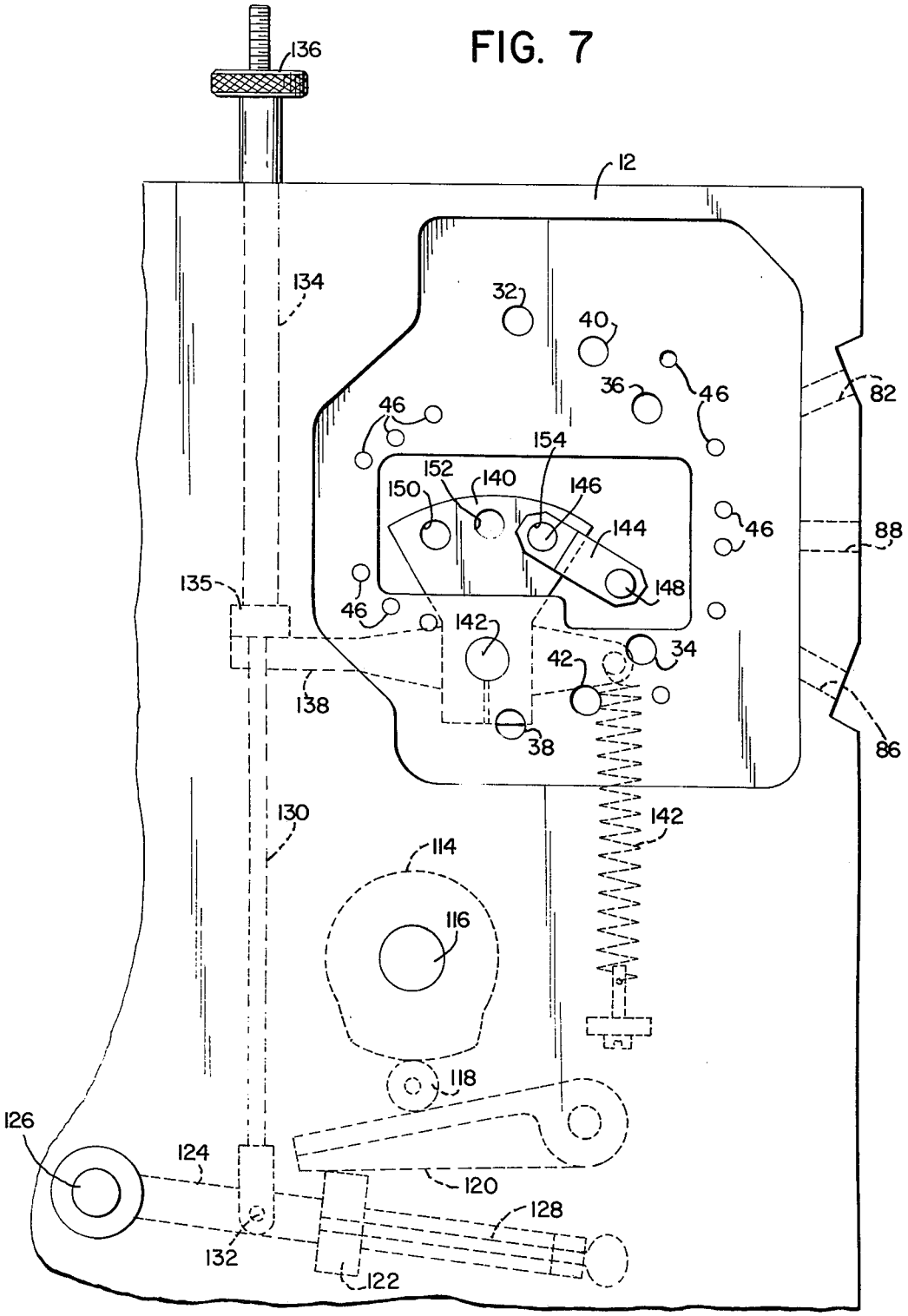
FIG. 7 is an enlarged fragmentary view of a portion of the coiling machine immediately behind the tool slide assembly with the said assembly removed from the machine and with an automatic diamter control means for the slide assembly illustrated partially in broken line form.

As is conventional in coiling machines of the type under consideration, a means for automatically controlling spring diameter during coiling of the spring is provided. Referring particularly to FIG. 7, a cam 114 shown in broken line form is mounted on a shaft 116 and operates a follower 118 in turn operating an oscillable lever 120. The lever 120 drives the lever 124 through an enlarged portion 122 on the latter. the lever 124 is pivotally connected at 126 and an adjustment screw 128 provides for longitudinal adjustment of the enlargement 122. A vertically extending rod 130 is pivotally connected at 132 with a lever 124 so as to be vertically reciprocable thereby and a tube 134 for adjustment of the diameter control extends upwardly from a stop member 135 on the lever 130 to an adjustment knob 136 above the frame 112 of the machine. The stop member 135 engages a lever 138 at a left-hand end portion and drives the same whereby to swing a slide actuating lever 140, a tension spring 142 being provided at a right-hand end portion of the lever 138. The automatic diameter control as thus far described is substantially identical with that of coiling machines illustrated and described in the aforementioned patents and reference may be had thereto for further explanation.

With the shaft 116 operating in timed relationship with the feed means and with remaining components of the coiling machine, it will be apparent that the actuator 140 will be swung by the lever 138 and its pinned connection 142 leftwardly and rightwardly as may be desired for diameter control. A connecting link 144 is associated with the lever 140 and has a rearwardly projecting pin 146 at a left-hand end portion and a forwardly projecting pin 148 at a right-hand end portion thereof. Further, first second and third pin receiving openings 150, 152 and 154 are provided in the lever 140. As will be apparent, the pin 146 may be entered selectively in the openings 150, 152 and 154 as required for the mounting of the tool slide assembly in its three discrete positions.

When the tool slide assembly is in the two point right-hand position of FIG. 2, the pin 146 at the left-hand end of the connecting link 144 is entered in the opending 150 in the lever 140. The forwardly projecting pin 148, at the right-hand end of the connecting link is entered in an opening 156 in the slide 28, FIG. 3. With the tool slide assembly in the left-hand two point coiling position of FIG. 4, the link 144 has its pin 146 entered in the opening 154 in the lever 140 and the pin 148 at the right-hand end of the link is entered in an opening 158 in the slide 28, FIG. 3. In the horizontal or single point coiling position of the tool slide, FIG. 5, the pin 146 on the link 144 is entered in the intermediate opening 152 in the lever 140 and the pin 148 is entered in the opening 156 in the slide 28. Thus, a driving connection between the link 144 and the slide 28 may be effected in each of the three positions of the tool slide assembly. As will be apparent, the slide 28 may be operated by the diameter control means in timed relationship with feed means whereby to vary the diameter of a spring during coiling. Such operation is of course employed with Barrel springs, taper springs, etc.

Referring particularly to FIG. 4, it will be observed that the lever 90 is reversed to provide its free end portion at a lower end thereof and the first and second tool holders are relatively reversed. As indicated above, it may be desirable as a matter of convenience to provide for separate bracket portions of the tool holders 50 and 100 or in the alternative, the brackets 50 and 100 may be adapted so as to be reversible and selectively mountable. The main body portions 56, 58 of the tool holders may be substantially identical and reversibly mounted as indicated above. Operation of the manual diameter control or adjustment means and the automatic diameter control or adjustment means is the same as described above and simultaneous adjustment of the two coiling tools or points 64, 112 occurs as indicated above. As best illustrated in FIG. 6, a cap 160 may be provided for the unused lug 32, 34. That is, when the lever 90 is pivoted at a lower end as in FIG. 2, the cap may be provided at the upper lug 32 and, conversely, when the lever 90 is pivoted at an upper end portionn as in FIG. 4, the cap 160 may be mounted at the lower lug 34 to cover the opening therein.

Single point coiling is conventional in most respects. With the tool slide assembly 26 mounted in the horizontal position as illustrated in FIG. 5, a third coiling tool holder 162 is pivotally connected to the slide 28 at the pin 94. Upper and lower adjusting screws 164, 166 provide for the movement of a coiling point or tool 168 angularly upwardly and downwardly for right-hand and left-hand coiling. That is, the coiling point 168 may be positioned as shown slightly above the line of wire feed for right-hand single point coiling. Conversely, the point may be moved downwardly below the line of wire feed for conventional single point left-hand coiling. With the manual and automatic diameter control means connected as described above, the desired diameter control and adjustment is achieved. Two caps 160, 160 are preferably provided for the lugs 32, 34 when the machine is adapted for the single point mode of coiling.

As will be apparent from the foregoing, a dual purpose coiling machine has been provided wherein a desirably simple and yet efficient construction is employed. Two point and single point coiling may be employed with springs of either hand and conversion from one mode of coiling and from right to left-hand or vice versa within a single mode of coiling is achieved with a high degree of ease and convenience.

I claim:

1. In a dual purpose spring coiling machine, the combination of an upstanding main supporting frame, feed means on said frame for intermittently advancing spring wire in a horizontal longitudinal direction, a spring coiling station at a front portion of said frame, a wire guide means on said frame between said feed means and coiling station, an arbor on said frame at said coiling station and projecting laterally and generally horizontally forwardly and which is adapted to engage wire advanced longitudinally past said guide means by said feed means, a pritch tool supported by said frame at said coiling station and engageable with and operable laterally to displace wire advanced longitudinally by said feed means, a spring cut-of tool supported by said frame and movable toward and away from said coiling station, and a coiling tool slide assembly arranged on a side of said arbor generally opposite said feed means and wire guide means, said assembly comprising a coiling tool slide, a guide mountable selectively on said frame in at least two discrete angularly related positions, said guide being adapted to support said slide for rectilinear movement in one and an opposite direction and toward and away from said coiling station at each of its said discrete positions, and at least two coiling tool holders carrying coiling tools and mountable selectively on said slide for different spring coiling functions.

2. The combination in a spring coiling machine as set forth in claim 1 wherein said frame and guide are adapted for selective mounting of the latter in first and second discrete positions respectively for coiling one and opposite hand springs, and wherein said slide and said first and second tool holders are adapted for selective mounting and concurrent use of the latter in first and second discrete positions, the said latter positions being relatively reversed and effective respectively for the two-point coiling of springs of one and an opposite hand.

3. The combination in a spring coiling machine as set forth in claim 2 wherein said first tool holder is mountable selectviely on said slide in first and second relatively reversed positions for rectilinear movement therewith toward and away from said coiling station, and wherein an intermediate support means is provided for mounting said second tool holder on said slide, said support means being reversibly mountable on said slide and movable both with and relative to said slide and toward and away from said coiling station whereby to provide for selective first and second relatively reversed positions of said second tool holder and for movement of the latter both with the relative to said slide and toward and away from said coiling station.

4. The combination in a spring coiling machine as set forth in claim 3 wherein said support means takes the form of a lever reversibly pivotably mountable on said slide and movable arcuately by the slide in one and an opposite direction when the slide is moved in said one and opposite directions rectilinearly, said second tool holder being mountable on a free end portion of said lever and an opposite end portion thereof being fixed against movement with said slide.

5. The combination in a spring coiling machine as set forth in claim 4 wherein a manually operable spring diameter control device is provided for selectively adjusting and fixing the position of said slide relative to said coiling station in each of said first and second guide positions, the positions of said first and second tool holders and their respective tools thus being simultaneously adjusted and fixed.

6. The combination in a spring coiling machine as set forth in claim 5 wherein said diameter control device comprises an adjusting screw and associated lock nut, the former having one end portion thereof connectible with said slide, and wherein said frame has first and second threaded openings alignable respectively with said slide with said guide in its said first and second positions, said screw being selectively entered in said openings and connected with said slide for adjustment and locking of the slide in a desired position.

7. The combination in a spring coiling machine as set forth in claim 5 wherein an automatically operabble spring diameter control device is provided for selective connection with said slide in each of said first and second positions of said guide, said controol device comprising a slide actuator means connectible with said slide with said guide in each of said first and second positions and adapted to effect rectilinear slide movement, and drive means connected with said actuator means and operble in timed relationship with said feed means whereby to effect rectilinear slide movement and thus to vary the diameter of a spring during coiling.

8. The combination in a spring coiling machine as set forth in claim 7 wherein said actuator means comprises an oscillable actuator lever and a conencting link extending therefrom and drivingly connectible with the slide, said lever having a plurality of openings and said connecting link having a lateral pin at one end for selective entry in said openings corresponding with said guide position.

9. The combination in a spring coiling machine as set forth in claim 8 wherein said connecting link has a second lateral pin at an opposite end, and wherein said slide has a plurality of openings for selective entry of said second pin corresponding with said guide position.

10. The cobination in a spring coiling machine as set forth in claim 9 wherein said drive means comprises a diameter control cam operable in timed relationship with said wire feed means, and motion transmitting means connected between said cam and said actuator lever for said slide.

11. The combination in a spring coiling machine as set forth in claim 3 wherein each of said first and second coiling tool holders is provided with adjsutment means for angular adjustment of a coiling tool held thereby about the axis of the tool, and for linear adjustment of the tool along ist axis toward and away from the coiling station.

12. The combination in a spring coiling machine as set forth in claim 11 wherein each of said tool holders is provided with means for adjustment of the free end of its coiling tool along an arc in a plane containing the axis of a spring at said coiling station.

13. The combination in a spring coiling machine as set forth in claim 12 wherein each of said tool holders is provided with means for adjustment of the free end of its coiling tool along an arc in a plane perpendicular to the axis of a spring at said coiling station.

14. The combination in a spring coiling machine as set forth in claim 2 wherein said supporting frame and guide are adapted for the selective mounting of said guide in a third discrete position, and wherein a third coiling tool holder is provided for mounting on said tool slide with said guide in said third position, said third tool holder being adapted for the single point coiling of springs.

15. The combination in a spring coiling machine as set forth in calim 14 wherein said first and second guide positions viewed from said coiling station are inclined respectively upwardly and downwardly from the horizontal through an angle of 22½°, and wherein said third position of said guide is horizontal.

16. The combination in a spring coiling machine as set forth in claim 14 wherein said third tool holder includes adjustment means for selectively positioning a free end of a coiling tool held thereby above and below the line of wire feed respectively for the single point coiling of right and left-hand springs.

17. The combination in a spring coiling machine as set forth in claim 16 wherein a manually operable spring diameter control device is provided for selectively adjusting and fixing the position of said slide relative to said coiling station in each of said three guide positions, the positions of coiling tools in said tool holders thus being adjusted and fixed.

18. The combination in a spring coiling machine as set forth in claim 17 wherein an automatically operable spring diameter control device is provided for selective connection with said slide in each of said three positions of said guide, said control device comprising a slide actuator means connectible with said slide with said guide in each of said three positions and adapted to effect rectilinear slide movement, and drive means connected with said actuator means and operable in timed relationship with said feed means whereby to effect rectilinear slide movement and thus to vary the diameter of a spring during coiling.

19. The combination in a spring coiling machine as set forth in claim 18 wherein each of said first and second coiling tool holders is provided with adjustment means for angular adjustment of a coiling tool held thereby about the axis of the tool, for linear adjustment of the tool along its axis toward and away from the coiling station, for adjustment of the free end of the tool along an arc in a plane containing the axis of a spring at said coiling station, and for adjustment of the free end of the tool along an arc in a plane perpendicular to the axis of a spring at said coiling station.

20. The combination in a spring coiling machine as set forth in claim 16 wherein said guide is provided with a pair of laterally spaced rearwardly projecting locating pins, and wherein said supporting frame is provided with three laterally spaced pairs of locating holes, said three pairs of holes being positioned respectively for locating said guide in its aforesaid three positions with said locating pins entering a corresponding pair of locating holes in each of said positions.

21. The combination in a spring coiling machine as set forth in claim 20 wherein said frame is provided with three groups of guide mounting holes respectively for said three guide positions, and wherein said guide is provided with a group of mounting holes cooperable with each of said groups of mounting holes.

22. In a two point spring coiling machine, the combination of an upstanding main supporting frame, feed means on said frame for intermittently advancing spring wire in a horizontal longitudinal direction, a spring coiling station at a front portion of said frame, a wire guide means on said frame between said feed means and coiling station, an arbor on said frame at said coiling station and projecting laterally and generally horizontally forwardly and which is adapted to engage wire advanced longitudinally past said feed means, a pitch tool supported by said frame at said coiling station and engageable with and operable laterally to displace wire advanced longitudinally by said feed means, a spring cut-off tool supported by said frame and movable toward and away from said coiling station, and at least one coiling tool slide assembly arranged on a side of said arbor generally opposite said feed means and wire guide means, said assembly comprising a coiling tool slide, a guide on said frame and supporting said slide for rectilinear movement in one and an opposite direction and toward and away from said coiling station, a first coiling tool holder mounted on said slide for rectilinear movement therewith and for similar movement of a coiling tool thereon toward and away from said station, a lever having one end portion fixed relative to said slide and a pivotal connection with said slide at an intermediate portion for arcuate movement in one and an opposite direction of an opposite and free end portion on rectilinear movement of said slide in said one and an opposite directions, and a second coiling tool holder mounted on said opposite and free end portion of said lever for arcuate movement of a coiling tool thereon with and relative to said rectilinear slide movement and toward and away from said station.

23. The combination in a spring coiling machine as set forth in claim 22 wherein a manually operable spring diameter control device is provided for selectively adjusting and fixing the position of said slide relative to said coiling station, the positions of said first and second tool holders and their respective tools thus being simultaneously adjusted and fixed.

24. The combination in a spring coiling machine as set forth in claim 23 wherein said diameter control device comprises an adjusting screw and associated lock nut, the former having one end portion thereof connected with said slide, and wherein said frame has at least one threaded opening alignable with said slide, said screw being entered in said opening and connected with said slide for adjustment and locking of the slide in a desired position.

25. The combination in a spring coiling machine as set forth in claim 24 wherein an automatically operable spring diameter control device is provided for connection with said slide, said control device comprising a slide actuator adapted to effect rectilinear slide movement, and drive means connected with said actuator means and operable in timed relationship with said feed means whereby to effect rectilinear slide movement and simultaneous movement of both tool holders and thus to vary the diameter of a spring during coiling.

26. The combination in a spring coiling machine as set forth in claim 25 wherein said drive means comprises a diameter control cam operable in timed relationship with said wire feed means, and motion transmitting means connected between said cam and said actuator lever for said slide.

27. The combination in a spring coiling machine as set forth in claim 26 wherein each of said first and second coiling tool holders is provided with adjustment means for angular adjustment of a coiling tool held thereby about the axis of the tool, for linear adjustment of the tool along its axis toward and away from the coiling station, for adjustment of the free end of the tool along an arc in a plane containing the axis of a spring at said coiling station, and for adjustment of the free end of the coiling tool along an arc in a plane perpendicular to the axis of a spring at said coiling station.

28. The combination in a spring coiling machine as set forth in claim 22 wherein said slide is arranged along a centerline inclined from the horizontal through an angle of 22½°.

29. The combination in a spring coiling machine as set forth in claim 28 wherein said lever and second tool holder are arranged to provide for said arcuate movement of said coiling tool along an arc approximately on a line inclined from the vertical through an angle of 22½°.

* * * * *